US005431755A

United States Patent [19]

Hajo et al.

[11] Patent Number: 5,431,755

[45] Date of Patent: Jul. 11, 1995

[54] METHOD OF AND ARRANGEMENT FOR THERMAL TREATMENT OF CONTINUOUSLY MOVING METAL BANDS

[75] Inventors: Helmut Hajo, Bovenden; Wilhelm Ernenputsch, Ratingen; Udo Unger, Leichlingen, all of Germany

[73] Assignee: Vits Maschinenbau GmbH, Langenfeld, Germany

[21] Appl. No.: 228,124

[22] Filed: Apr. 15, 1994

[30] Foreign Application Priority Data

Apr. 24, 1993 [DE] Germany ..... 43 13 543.9

[51] Int. Cl.[6] ..... B65H 23/24

[52] U.S. Cl. ..... 148/703; 266/111

[58] Field of Search ..... 148/703; 266/102, 103, 266/111, 109

[56] References Cited

U.S. PATENT DOCUMENTS 4,270,959 6/1981 Matsumoto et al. ..... 266/103
4,405,386 9/1983 Mravic et al. ..... 266/103

FOREIGN PATENT DOCUMENTS 0192169 8/1986 European Pat. Off. .
3318861 11/1984 Germany .

*Primary Examiner*—Scott Kastler
*Attorney, Agent, or Firm*—Michael J. Striker

[57] ABSTRACT

During thermal treatment of continuously moving metal bands more heat is supplied over a part of a treatment path to edge regions of the band per surface unit than to the center region of the band. This prevents formation of a wavy shape in the edge regions of the metal band which is advantageous for a further treatment.

9 Claims, 1 Drawing Sheet

METHOD OF AND ARRANGEMENT FOR THERMAL TREATMENT OF CONTINUOUSLY MOVING METAL BANDS

BACKGROUND OF THE INVENTION

The present invention relates to a method of thermal treatment of continuously moving metal bands in particular aluminum bands, which is subjected along its treatment path to hot treatment gas and is floatingly guided.

The present invention also relates to an arrangement for thermal treatment of continuously moving bands which has a treatment chamber with a system of blowing boxes for guiding the metal bands in a floating condition by means of a hot treatment gas.

Methods and arrangements of the above mentioned general type are disclosed for example in the German document DE-PS 33 18 861 and in the European patent document EP-B1-0 192 169.

During the thermal treatment of continuously moving aluminum bands with a width of more than 0.5–1 m, there is a problem in known methods that with increasing band width there is an increasing moving speed they are distorted: in particular the edge regions of the bands assume a wavy shape. This waviness acts in disadvantageous manner during the later processing.

The cause of this waviness is probably the heat expansion of the band. Due to the heat expansion the band edges assume a curved shape in the heating region. A surface element located in the edge region and having a rectangular shape in stationary condition is deformed in the heating phase to a acute-angle parallelogram. With the utilized temperature the elasticity limit can be exceeded, so that the plastic or in other words permanent deformation occurs which leads to the expansion in the edge region. This expansion leads in turn to formation of the waves. During the subsequent cooling the reverse situation takes place.

It is possible that the edge expansions can be also partially explained by the fact that the insignificant lateral deviations from the straight movement direction in the edge regions lead to stresses with which in condition of the increased temperature plastic deformations occur.

For preventing the undesirable edge deformation it wa proposed on the one hand to supply the heat over the whole width as uniformly as possible, and on the other hand, to guide the band exactly. These efforts do not always bring the desired results. It has been shown that especially in the case of high moving speeds the waviness cannot be avoided. Therefore it was necessary to reduce the through output to maintain the waviness within acceptable limits.

SUMMARY OF THE INVENTION

Accordingly, it is an object of the present invention to provide a method of and an arrangement for thermal treatment of continuously moving metal bands, which avoids the disadvantages of the prior art.

In keeping with these objects and with others which will become apparent hereinafter, one feature of the present invention resides, briefly stated, in a method of thermal treatment of continuously moving metal bands, in particular aluminum bands, which are subjected to an action along a treatment path by a hot treatment gas and guided floatingly, wherein in accordance with the present invention at least over a part of the treatment path the edge region of the metal band is supplied with more heat per surface unit than a center region of the band.

In accordance with another feature of the present invention an arrangement is proposed for thermal treatment of continuously moving metal bands, which arrangement has a treatment chamber in which a system of blow boxes is arranged for guiding the metal band in a floating condition by means of a heat treatment gas, wherein in accordance with the present invention at least a part of the length of the treatment chamber is associated with heat transmitting means formed for an increased heat supply to the edge regions of the metal band when compared with the band center.

When the method is performed and the arrangement is designed in accordance with the present invention, also for wide bands and high moving speeds the wariness of the bands is avoided or at least reduced to an insignificant value.

In a surprising manner it has been found that when the method is executed as specified hereinabove and the arrangement is designed as specified hereinabove, the above mentioned advantageous results are fully achieved. This is especially surprising since the inventive features actually do not contact the cooling region. For reasons which for now are not completely explainable the shrinkage process which occurs in the cooling region has no substantial influence on the edge wariness.

In accordance with another feature of the present invention the increased heat supply to the edge region is performed only over a partial path which extends to the center of the treatment path. For this purpose in the arrangement in the part of the treatment chamber which extends from the band inlet to its center, heat transfer means are arranged, which are used for an increased heat supply to the edge region of the band. The increased heat supply to the edge region can be performed only over a partial path which starts approximately 20% of the treatment path and extends to its center. This is achieved by arranging the heat transferring means in this region. It has been found that optimal results are obtained when the increased heating of the edge region is limited to the above mentioned partial paths.

In accordance with still a further feature of the present invention, the increased heat supply to the edge regions is performed by blowing a more intense treatment gas stream to the edge region than to the center region of the band. This can be achieved in that the blow boxes are formed as air cushion nozzles arranged transversely to the movement direction and each having two parallel perforation rows or slots, and each perforation row or each slot is associated with a cover plate which covers the perforation row or the slot in the edge regions less than in the center region of the band. This requires little additional costs to execute the invention. It is naturally also possible for the purpose of increased heat supply to arrange additional heat transferring means such as for example irradiator, in the edge regions.

In a production installation in which the moving speed of aluminum bands of a predetermined width must be limited for avoiding the waviness to 120 m/min while in accordance with the present invention the speed can be increased to 200 m/min without disturbing edge waviness.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
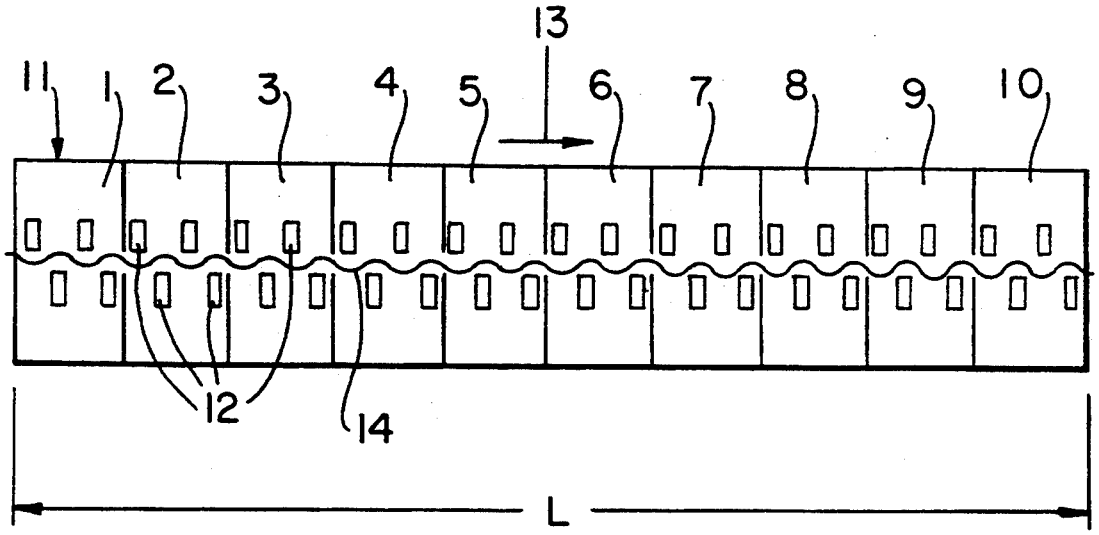
FIG. 1 is a side view of a heat treatment arrangement for metallic bands in accordance with the present invention.

An arrangement in accordance with the present invention has a treatment chamber which is identified with reference numeral 1. It is formed of modular blocks and has a plurality of fields 1–10. A plurality of blowing boxes formed as small air cushion nozzles 12 extending over the width of the treatment chamber 11 are arranged above and below a horizontal band guiding plane over the whole length of the treatment path in the treatment chamber. The air cushion nozzles 12 are connected with a pressure side of fans, which at their suction side communicate with an inner space of the treatment chamber. Treatment gas which blows from the blowing openings of the air cushion nozzles 12 and flow through intermediate spaces between the individual nozzles is heated with a not shown heating body to approximately 350° C. and supplied in circulation. The upper nozzles are arranged relative to the lower nozzles with gaps, so that an aluminum band 14 moving in direction of the arrow 13 has a sinus-like course which contributes to a stable floating position.

A not shown cooling field is located after the treatment chamber 11 and connected with it. The cooling field is formed analogously to the fields 1 through 10 of the treatment chamber 11.

Figure 2:
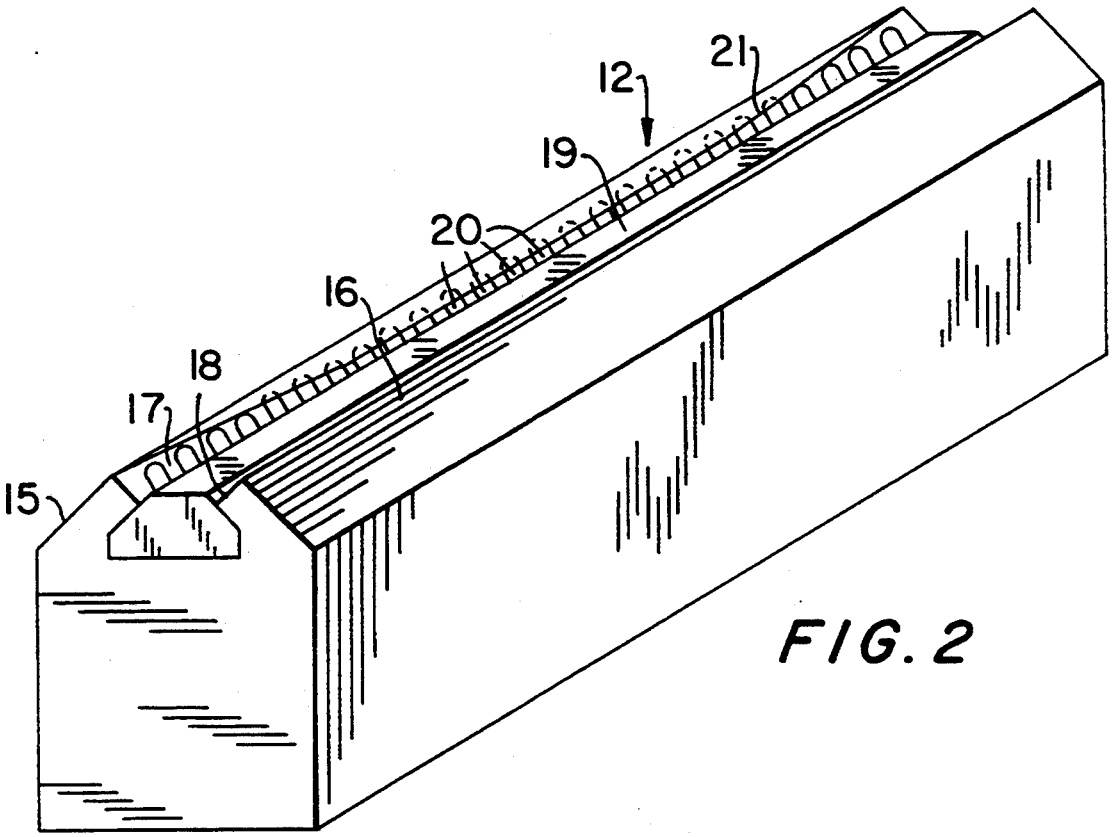
FIG. 2 is a view showing a modified air cushion nozzle of the heat treatment arrangement in accordance with the present invention.

As shown in FIG. 2 each air cushion nozzle 12 has a profiled wall surface which faces the moving aluminum band 14 and has two edge strips 15 and 16 falling toward the edges in a roof-like fashion, two opposite webs 17 and 18 adjoining the edge strips and inclined opposite to the latter, and an upper surface zone 19 located therebetween and extending substantially parallel to the guiding plane. The both webs 17 and 18 are each provided with a perforation row 20. Due to the inclined position of the both webs 17, 18 the blowing direction of the exiting treatment gas jets are also inclined, so that they converge in direction of the moving aluminum band.

The above described construction corresponds to the construction of the arrangement in accordance with the prior art.

In accordance with the present invention, in the fields 3, 4, 5, or in other words over a partial path which starts at 20% of the treatment path and extends to its center, the perforation rows of the air cushion nozzles 12 are partially covered by a plate as identified with a line 21 in FIG. 2. The cover plate has an arcuate edge corresponding to the line 21 so that the perforations 20 near the edge are completely free and only are covered in the band center in an increasing degree. Thereby the edge regions of the moving aluminum band 14 is supplied with a more intense treatment gas stream than the band center. This corresponds to a higher heat supply, so that the edge regions of the aluminum band 14 are heated to a higher temperature than the region of the band center.

The required value of the covering must be determined experimentally for each individual application.

The arrangement is especially efficient for treatment of aluminum bands with a width between 0.5 and 2.5 m and a thickness of between 0.02 and 1.5 mm.

It will be understood that each of the elements described above, or two or more together, may also find a useful application in other types of constructions and methods differing from the types described above.

While the invention has been illustrated and described as embodied in a method of and an arrangement for thermal treatment of continuously moving metal bands, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of thermal treatment of continuously moving metal bands, comprising the steps of acting on a metal band with a hot treatment gas and floatingly guiding the metal band along a treatment path; and supplying to edge regions of the metal band over at least a part of the treatment path, with more heat per square unit than to a center region of the metal band, said supplying includes supplying more heat to the edge region by blowing a treatment gas stream which floatingly guides the metal band, more intensely in the edge regions than in the center region of the band.

2. A method as defined in claim 1, wherein said supplying includes supplying more heat to the edge regions over a part of the treatment path which extends only to a center of the treatment path.

3. A method as defined in claim 2, wherein said supplying includes supplying more heat to the edge regions over a part of the treatment path, which part starts at approximately 20% of the treatment path and extends to the center of the treatment path.

4. An arrangement for a thermal treatment of continuously moving metal bands, comprising means for floatingly guiding a metal band along a treatment path; means for acting with a hot gas on the metal band along the treatment path, said means for acting being formed so that, at least over a part of the treatment path, edge regions of the metal band are supplied with more heat per surface unit than a center region of the metal band, said means including a treatment chamber in which a system of blow boxes for guiding metal band in a floating condition by means of a hot treatment gas is arranged, and a heat transmitting means arranged at lest on a part of the length of said treatment chamber and providing the supply of more heat to the edge regions of the metal band than to the center of the metal band, said blow boxes being formed as air cushion nozzles arranged transversely to a movement direction of the band and each having two parallel perforation rows; and a cover plate covering each of said perforation rows more in the edge regions of the band than in the center region of the band.

5. An arrangement as defined in claim 4 wherein said heat transmitting means is arranged in the part of the treatment chamber which extends from a band inlet of the treatment chamber to a center of the treatment chamber for providing the supply of more heat to the edge regions of the band.

6. An arrangement as defined in claim 5, wherein said heat transmitting means is arranged in the part of the treatment chamber which extends substantially from a distance from a band inlet of the treatment chamber equal to substantially 20% of a length of the treatment chamber and extending to the center of the treatment chamber, to provide the supply of more heat to the edge regions of the band.

7. An arrangement for a thermal treatment of continuously moving metal bands, comprising means for floatingly guiding a metal band along a treatment path; means for acting with a hot gas on the metal band along the treatment path, said means for acting being formed so that, at least over a part of the treatment path, edge regions of the metal band are supplied with more heat per surface unit than a center region of the metal band, said means including a treatment chamber in which a system of blow boxes for guiding metal band in a floating condition by means of a hot treatment gas is arranged, and a heat transmitting means arranged at lest on a part of the length of said treatment chamber and providing the supply more heat to the edge regions of the metal band than to the center of the metal band, said blow boxes being formed as air cushion nozzles arranged transversely to a movement direction of the band and each having two parallel slots; and a cover plate covering each of said slot more in the edge regions of the band than in the center region of the band.

8. An arrangement as defined in claim 7, wherein said heat transmitting means is arranged in the part of the treatment chamber which extends from a band inlet of the treatment chamber to a center of the treatment chamber for providing the supply of more heat to the edge regions of the band.

9. An arrangement as defined in claim 8, wherein said heat transmitting means is arranged in the part of the treatment chamber which extends substantially from a distance from a band inlet of the treatment chamber equal to substantially 20% of a length of the treatment chamber and extending to the center of the treatment chamber, to provide the supply of more heat to the edge regions of the band.

* * * * *